US008753041B2

(12) United States Patent
Gray

(10) Patent No.: US 8,753,041 B2
(45) Date of Patent: Jun. 17, 2014

(54) INJECTION, SEALING VALVING AND PASSAGEWAY SYSTEM

(76) Inventor: Peter Andrew Gray, Figtree (AU)

( * ) Notice: Subject to any disclaimer, the term of this patent is extended or adjusted under 35 U.S.C. 154(b) by 416 days.

(21) Appl. No.: 13/119,741

(22) PCT Filed: Sep. 18, 2009

(86) PCT No.: PCT/AU2009/001239
§ 371 (c)(1),
(2), (4) Date: Mar. 18, 2011

(87) PCT Pub. No.: WO2010/031132
PCT Pub. Date: Mar. 25, 2010

(65) Prior Publication Data

US 2011/0168398 A1 Jul. 14, 2011

(30) Foreign Application Priority Data

Sep. 18, 2008 (AU) ..... 2008904851
Jul. 9, 2009 (AU) ..... 2009202836

(51) Int. Cl.
*E21D 20/02* (2006.01)

(52) U.S. Cl.
CPC ..... *E21D 20/028* (2013.01)
USPC ..... 405/259.1; 405/259.5

(58) Field of Classification Search
USPC ..... 405/258.1, 259.1–259.6
See application file for complete search history.

(56) References Cited

U.S. PATENT DOCUMENTS

| | | | | |
|---|---|---|---|---|
| 3,994,138 | A | 11/1976 | Herbst | |
| 4,302,132 | A * | 11/1981 | Ogawa et al. | 405/269 |
| 5,622,454 | A | 4/1997 | Ashmore et al. | |
| 5,653,557 | A | 8/1997 | Gruber | |
| 5,997,219 | A | 12/1999 | Krzysztalowicz et al. | |
| 6,793,445 | B1 * | 9/2004 | Charlton et al. | 405/259.5 |
| 2005/0077041 | A1 | 4/2005 | Gessay et al. | |

FOREIGN PATENT DOCUMENTS

| | | | |
|---|---|---|---|
| AU | 199959340 | A1 | 5/2000 |
| DE | 102007008966 | A1 | 9/2007 |
| WO | WO 92/08040 | | 5/1992 |
| WO | WO 2006/042530 | A1 | 4/2006 |
| WO | WO 2007/059580 | A1 | 5/2007 |

* cited by examiner

*Primary Examiner* — Benjamin Fiorello
*Assistant Examiner* — Kyle Armstrong
(74) *Attorney, Agent, or Firm* — Gordon & Jacobson, PC

(57) ABSTRACT

The invention provides an injection, sealing, valving and passageway system for use with hollow rock bolts and hollow injection bars used in mining, civil engineering, tunneling and construction including use with hollow self drilling rock bolts. The invention comprises a plurality of passageways with one or more one way flow valves along the passageways. The invention enables one or more fluids to be pumped into a hollow rock bolt or other hollow elongate member either sequentially or simultaneously without cross contamination of fluids in another passageway or back flow of fluids along the wrong passageway. The invention is typically used to install self drilling rock bolts whereby a drilling fluid is initially pumped through the hollow bolt during the drilling cycle, and then a two part chemical resin or cement grout is pumped through the hollow bolt to anchor the bolt in the borehole.

21 Claims, 9 Drawing Sheets

INJECTION, SEALING VALVING AND PASSAGEWAY SYSTEM

The invention broadly relates to a valve or valves or passageways, and more specifically, relates to valves and passageways adapted to control the flow of fluids. More specifically still, the invention relates to an injection, sealing, valving and passageway system adapted to direct and control the flow of fluids through hollow drill rods, hollow rock bolts or hollow self drilling rock bolts.

BACKGROUND TO THE INVENTION

The flow of fluids, typically water, or air, or cement grout or resin, is commonly pumped through hollow tubes, hollow drill rods, hollow rock bolts and hollow self drilling rock bolts in the mining and tunneling industries. Most commonly water or air is used to flush rock cuttings out of boreholes as they are being drilled by hollow drill rods. Also cement grout or resin is commonly pumped through the central hole in hollow injection rods to stabilise broken, fractured or weak rock or ground. In addition, cement grout or resin is also commonly pumped through hollow rock bolts or hollow self drilling rock bolts to anchor those rock bolts into rock or soil. An example of a hollow self drilling rock bolt with a drilling tip at one end is given in patent number PCT/AU91/00503.

The hollow drill rods or hollow rock bolts may be made from any suitable hollow bar including tubes, pipes or thick-walled hollow bars, and are typically made from steel but could be made from fibreglass or plastic or carbon fibre.

Where fluids are pumped through a hollow bar for any of the above applications, a sealing means is normally used between the hollow bar and the fluid pumping system. Typically, where drilling applications using drill rods are being used, the fluid pumping system is through the drilling machine using either water or air.

This sealing means can be as simple as a screw thread on the end of the hollow bar or hollow drill rod or hollow rock bolt which is screwed into a mating thread inside the drill chuck on the drilling machine. Alternatively this sealing means is typically an O ring either on the end of the hollow bar, or inside the drill chuck. The O ring prevents leakage of the fluids as they are being pumped through the hollow bar, and they are a simple, low cost and proven method of sealing fluids for this application.

In some applications two fluids are pumped through a hollow bar at the same time for drilling applications. Typically this may be water and air such that a fine "mist" is used for drilling to minimise the volume of water used. Alternatively, two fluids may be pumped through a hollow bar at different times, for example, water may be used for drilling cycle to flush rock cuttings out of the borehole, and then cement grout may be subsequently pumped through the same hollow bar to fill the borehole with cement grout and anchor the hollow bar into the borehole.

In the civil and tunneling industries this operation is typically undertaken by firstly screwing the end of a hollow bar or hollow drill rod or hollow rock bolt with a thread on the end of it into a drill chuck, and then rotating the bar during the drilling cycle. The rotational action of the drilling machine tightens the mating threads between the bar and the drill chuck and creates a seal for the fluids used for the drilling cycle. Once the drilling cycle is complete, the bar is unscrewed form the drill chuck and a screw fitting attached to a grout hose is typically screwed onto the end of the bar. This screw fitting is typically manually tightened up onto the end of the bar such that a fluid seal is created which then allows cement grout or resin or other chemical anchoring fluid to be pumped into and through the bar to fill the borehole. Once the borehole is full of the cement grout or other anchoring fluid, then the screw fitting is unscrewed from the bar and removed.

The use of screw threads or O rings are therefore the most common forms of sealing for pumping fluids through hollow bars, hollow drill rods or hollow rock bolts in the mining, civil and tunneling industries.

The screwing and unscrewing of screw threads is a cumbersome operation and where cement grout hoses and fittings are used, it is typically undertaken manually. This is a time consuming operation and is not suited to automation of the grouting process.

In addition, the use of either screw threads or O Rings for sealing of fluids being pumped through hollow bars is principally designed for sealing against leakage at the seal itself, and they are not designed to direct and control the flow of fluids either inside the drill chuck or inside the hollow bar.

In the particular case of self drilling rock bolts, water, or air, or water and air, known as the "drilling fluid" are typically pumped through the bolt to remove the rock cuttings from the drilling operation to drill a borehole. An example of a self drilling rock bolt is given in patent number PCT/AU2006/001775. A sealing device is used to prevent leakage of the drilling fluid between the drilling machine and the bolt. Once the borehole has been drilled, and all the rock cuttings have been removed from the borehole, pumping of the drilling fluid is then turned off. Then cement grout, or resin, or other chemical fluid, known as the anchoring fluid, is typically pumped through the bolt to fill the borehole and fully encapsulate the bolt in the borehole and once the anchoring fluid cures and hardens, it anchors and fixes the bolt in the borehole. Typically with current systems, the drilling fluid and the anchoring fluid are pumped into self drilling rock bolts through separate hoses and fittings which have to be separately attached and detached from the end of the self drilling rock bolt, and typically this is done manually.

Moreover, if a two part chemical resin is pumped into a hollow bar, or into a hollow bolt or into a hollow self drilling rock bolt, then the two part chemical resin normally consists of a hardenable component (known as a mastic component) and a hardening component (known as a catalyst component). Typically once the mastic component comes into contact with the catalyst component the resin will start to cure, and it may harden in less than 60 seconds, typically it will harden in less than 30 seconds. Clearly then the mastic component must be kept completely separate from the catalyst component, while these two components of the resin are being pumped through the drilling machine and through the drilling chuck of the drilling machine, otherwise it will cure and harden and clog the drilling chuck. In addition, if an injection nozzle is used in the drilling chuck to inject the two part resin into the hollow bolt, then the two parts of the chemical resin, the mastic component and the catalyst component, must also be kept separate immediately after or above the injection nozzle, otherwise premature curing can occur and cause blockages of this injection nozzle.

Furthermore if the pumping pressures within the mastic component and the catalyst component as they flow out of the injection nozzle are unequal, then it is possible to get backflow of either mastic or catalyst down the wrong passageway, and this can cause blockages within the injection nozzle. An injector for use with self drilling rock bolt which does not have a one way valving and passageway system as described this invention, is prone to blockages and an example of such an injector is given in patent number AU199959340 A1.

More particularly where an injection nozzle is used to pump one or more fluids into a hollow bar either simultaneously or sequentially, there is a considerable advantage in being able to use that one injection nozzle to pump one or more fluids into the hollow bar without the requirement to screw or unscrew different fittings onto the end of the bar to pump different fluids into the bar. However, the resin injection system as shown in patent number AU199959340 A1 is prone to blockages. The inventor has found that if the mastic part of a liquid resin and the catalyst part of a liquid resin are allowed to come together immediately at the end of an injector, then the end of the injector is likely to become clogged with resin that has cured and hardened. To prevent the injector becoming clogged with hardened resin it is necessary to keep the mastic part of the resin and the catalyst part of the resin completely separate as they leave the injector and force them to flow along their own separate passageways inside the end of the bolt. The mastic and catalyst then flow along their own separate passageways inside the bolt, and only come together and mix at some point further away from the end of the injector. In practice the distance between the end of the injector and the point where the mastic and catalyst come together and mix may be small and typically be between 5 mm and 50 mm but is not so limited.

Moreover, the inventor has further found that where two or more fluids are being pumped into a hollow bar either simultaneously or sequentially, it is often necessary to prevent back flow of one or more fluids in the wrong direction down a passageway used for another fluid, and or it is often necessary to prevent premature mixing of two or more fluids. Moreover, if two or more fluids are being pumped into a hollow bar simultaneously, the pumping pressures for each fluid may not be equal and this could cause back flow or flow through the wrong passageway. Therefore it is necessary to have a one way valving system that will prevent back flow of liquid resins along the wrong passageway, and typically this can be achieved by having separate one way valves along each passageway inside the bolt.

Furthermore, if separate passageways and one way valves are only used in the injector, clogging of the end of the injector by curing and hardening of two part liquid resins is still possible. For example patent number WO2006042530 shows an injection head with two separate passageways with two separate valves which then combine into a single passageway in a connecting piece which is then inserted into the end of a hollow bar or bolt. However this patent indicates that this single passageway in the connecting piece has to be flushed out after use, otherwise the two part liquid resins will cure and harden in the passageway entering the bolt making the injector unusable for subsequent bolts.

There is therefore a considerable advantage in having an injection, sealing, passageway and valving system for used with hollow self drilling rock bolts that enables:

- drilling rotation of the bolt;
- water or air flushing of the drill cuttings;
- injection of a liquid resin mastic component and injection of a liquid resin catalyst component into and through the bolt to fill the borehole;
- mixing, curing and hardening of the two liquid resin components to anchor the bolt in the borehole;
- tensioning of a nut on the end of the hollow self drilling rock bolt;
- removal of the injector from the hollow self drilling rock bolt;

and all be accomplished without back flow of resin along the wrong passageway in the injector, or contamination or clogging of any part of the injector, and leaving the injector completely clean after it is removed from the bolt and be ready to install the next hollow self drilling rock bolt.

Even further, there is a considerable advantage in being able to maintain a hydraulic seal or seals between a stationary injector with one or more passageways and a rotating bolt in which the injector is inserted into or is coupled to.

The present invention relates to an injection, sealing, passageway and valving means which overcomes the problems of existing systems described above and allows one or more fluids to be simultaneously or sequentially pumped into and through a hollow bar, a hollow drill rod or hollow rock bolt, without back flow or contamination and enabling the resin in the bolt to cure and harden without clogging the injector, and also leaving the injector completely clean after it is removed from the bolt and be ready to install the next bolt.

There is a need for improved mechanism or device to overcome the above problems of manually changing over separate hoses and fittings to pump different fluids into hollow bars, and to control and direct the flow of those fluids inside the hollow bar. Moreover there is a need to have separate passageways with optional one way valves to control the flow of chemical resins to prevent back flow, flow along the wrong passageway and avoid premature mixing and curing of chemical resins, grouts or other anchoring fluids.

The present inventor has developed an injection, sealing, valving and passageway system that can be installed substantially in the end of a hollow bar or a hollow drill rod or a hollow rock bolt or hollow self drilling rock bolt and or partially within an external injector that overcomes these problems and enables one or more fluids to be pumped into and through a hollow bar or hollow drill rod or hollow bolt or hollow self drilling rock bolt without premature mixing or back flow or leakage such that these bars, rods or bolts can be installed with a minimum of manual handling and without blockage of the injector or the dill chuck.

Furthermore the injection, sealing, valving and passageway system enables water to be pumped through a hollow self drilling rock bolt during the drilling operation while the bolt is being rotated, and then enables resin or cement grout to be pumped through the bolt during the grouting cycle, without any change to the sealing or valving system. The injection, sealing, valving and passageway system can not only function and hydraulically seal while a hollow self drilling rock bolt is being rotated at drilling speeds of typically 500 rpm, but it can also hydraulically seal and separate two part resins, chemicals or grouts during the grouting cycle. This has the considerable advantage that there is no requirement to change over fittings on the end of the bolt between the drilling cycle and the grouting cycle as occurs with current practice.

SUMMARY OF THE INVENTION

The present invention provides an injection, sealing, valving and passageway system (the "valving system") for use with hollow elongate members used in mining, civil engineering, tunneling and construction including use with self drilling rock bolts, where the valving system comprises a plurality of passageways whereby at least one of the passageways has at least one flow valve at some position along it. The flow valve is typically a one way flow valve.

The passageways can enable fluids to flow along them without cross contamination with the fluids in another passageway and where at least one of the passageways can accommodate the flow of one or more fluids along them either sequentially or simultaneously. Moreover, the passageways are typically substantially contained within a hollow bar or bolt and are also typically partially contained within an external injector that hydraulically seals with the hollow bar or bolt.

The passageways in the bar or bolt are then hydraulically connected and hydraulically sealed to the passageways in the injector both when there is no relative rotation between the bar and the injector and when there is relative rotation between the bar and the injector during the drilling cycle.

The side boundaries of the passageways could be formed by any means and are typically formed by one or more separate items or components. The inlet and outlet ends of the passageways are typically open, but also typically could have one or more one-way valves positioned anywhere along the length of the passageways. The passageways can be of unequal length and of unequal cross sectional area.

The passageways in an injector extend beyond the end of the injector such that fluids flowing along the separate passageways in the injector then subsequently flow along separate passageways in the bar or bolt and do not come together until after the end of the injector such that those fluids cannot mix at the end of the injector and harden and block the openings at the end of the injector.

The passageways within the hollow elongate member typically have a seal or seals to provide a hydraulic seal with the passageways contained within an external injection nozzle or nozzles.

Preferably the passageways have one or more one-way valve or valves that allow fluids to flow in one direction along the passageways but prevent flow of fluids in the opposite direction along the passageways.

Preferably the passageways can accommodate the flow of single or multiple fluids either sequentially or simultaneously.

Preferably, in practice, the passageway and valving assembly inside the bolt or bar (the "valving assembly") is made from plastic and substantially consists of a plastic cylindrical shaped member with at least one internal passageway and a one-way valve, and at least one external passageway with another one-way valve such that one fluid can be pumped through the internal passageway, and another fluid can be pumped through the external passageway.

Preferably as the self drilling rock bolt is inserted into a drilling machine, the valving system which is substantially contained inside the self drilling rock bolt forms a mating and sealing fit with an injection nozzle inside the drilling machine such that a hydraulic seal or hydraulic seals are formed between the passageways in the injection nozzle and the passageways in the bolt. The hydraulically seal or seals can operate when the bolt is being rotated during the drilling cycle, or when the bolt is stationary during the grouting cycle. Water or air or resin or cement grout or other fluids can then be pumped into the self drilling rock bolt through the injection nozzle and into the correct passageway through the valving system without back flow or flow through the wrong passageway thus avoiding premature mixing of fluids or other problems.

Preferably part of the plastic valving system can substantially wipe the injection nozzle clean when the injection nozzle is withdrawn from the bolt.

Preferably the valving system is only used to install one self drilling rock bolt but is not so limited.

Preferably the valving system has two separate passageways but is not so limited and could have three or more separate passageways, It is particularly preferred that the valving assembly substantially consists of one or more plastic cylinders with one or more circular plastic skirt or flap valves which close and hydraulically seal against a circular section of an injector. These skirt or flap valves open with fluid flow in one direction and close with any fluid flow in the opposite direction.

It is particularly preferred that the valving assembly in the bar or bolt can hydraulically seal against a stationary injector even if the valving assembly in the bar or bolt is being rotated.

It is particularly preferred that the valves in at least one passageway can allow multiple fluids to sequentially flow along it such that this passageway can be flushed out with a flushing fluid after resin or grout injection.

Persons skilled in the art would appreciate that different embodiments of the invention could be used with hollow self drilling rock bolts, hollow rock bolts, hollow injection tubes or any other device used for the flow of one or more fluids.

Throughout this specification, unless the context requires otherwise, the word "comprise", or variations such as "comprises" or "comprising", will be understood to imply the inclusion of a stated element, integer or step, or group of elements, integers or steps, but not the exclusion of any other element, integer or step, or group of elements, integers or steps.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed in Australia before the priority date of each claim of this specification.

In order that the present invention may be more clearly understood, preferred embodiments will be described with reference to the following drawings and examples.

DETAILED DESCRIPTION OF THE PREFERRED EMBODIMENTS

Figure 1:
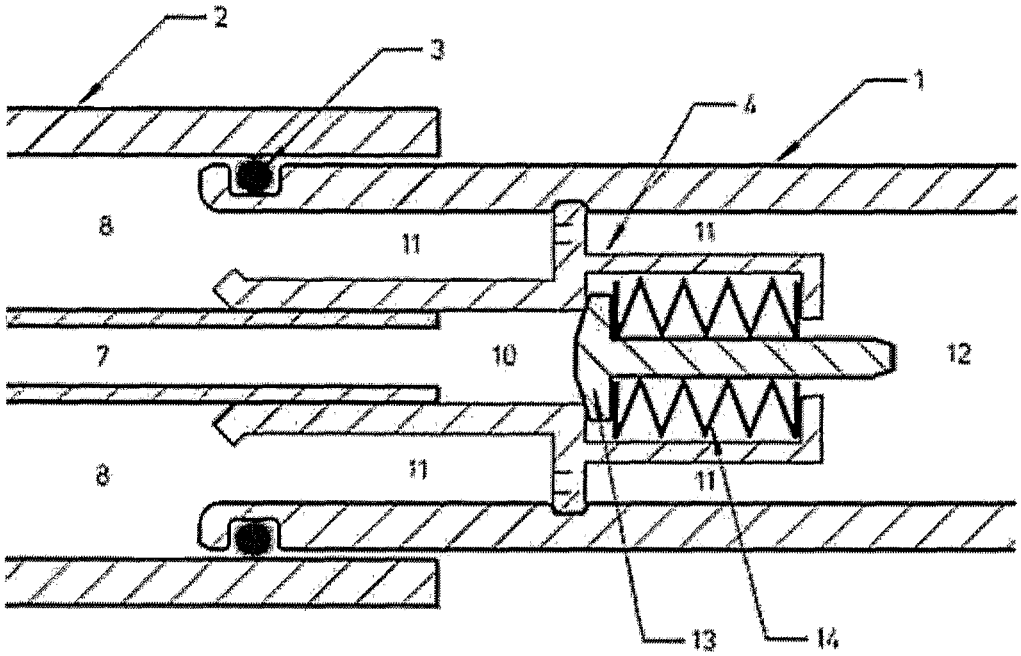
FIG. 1 is a schematic sectional view of an injection, sealing, valving and passageway system according to one preferred embodiment of the invention adapted to be used with a self drilling rock bolt showing a one way valve in a closed position.

Where the specification refers to a "bar" or to a "hollow bar" or to a "hollow drill rod" or to a "hollow rock bolt" or to a "hollow self drilling rock bolt" or to a "hollow elongate member" or to a "hollow injection tube" or to a "tube" or to a "pipe" it is to be understood that the invention includes all such variations and modifications of the above including any long hollow elongate member including self drilling rock bolts.

Where the specification refers to an "injection nozzle" or to a "nozzle" or to "nozzles" or to an "injector" or to an "external injector" it is to be understood that the invention includes all such variations and modifications of one or more injection nozzles that may have one or more passageways which can separate the flow of one or more fluids.

Where the specification refers to an "injection sleeve" or to a "sleeve" it is to be understood that the invention includes all such variations and modifications of an injection sleeve that can accommodate and seal with an external injector and the injection sleeve may contain one or more passageways and one or more one way flow valves and one or more seals.

Where the specification refers to an "seal" or to "seals" or to a "sealing device" it is to be understood that the invention includes all such variations and modifications of a seal including threads, O rings, flaps, valves, or any other device that can hydraulically seal a fluid against leakage or flow in an undesired direction.

Where the specification refers to a "valve" or to "valves" or to "one way valves" or to "one way flow valves" it is to be understood that the invention includes all such variations and modifications of a valve including one way flow valves or any device that can control or direct the flow of fluids.

Where the specification refers to a "flap valve" or to a "skirt valve" it is to be understood that the invention includes all such variations and modifications of a one way valve that opens by the flow of fluid in one direction and closes by the flow of fluid in the opposite direction.

Where the specification refers to a "passageway" or to "passageways" it is to be understood that the invention includes all such variations and modifications of the above, including tubes, pipes, holes of any shape, any assemblage of components that could form a through hole or through passageway, and any other member or assemblage of members that could contain fluids and enable fluids to flow through it. The passageways may be formed both during drilling rotation and when there is no drilling rotation.

Where the specification refers to a "valving system" or to a "valving and passageway system" it is to be understood that the invention includes an injection, sealing, valving and passageway system which could be formed by multiple parts and all such variations and modifications of the above, Where the specification refers to a "valving assembly" or to a "valving and passageway assembly" it is to be understood that the invention includes a valving and passageway assembly that includes at least one passageway and includes at least one one way valve and is typically formed by an assembly of plastic tubes and one way valves but includes all such variations and modifications of the above and could be formed in any way.

For consistency, in the Figures, item numbers refer to the same feature or design component.

The preferred embodiments shown in FIGS. 1 to 17 show the injection, sealing, valving and passageway system (the "valving system") whereby rotational movement can occur between the injector 2 and the bar 1 and a hydraulic seal can still be maintained between the passageways in the injector 2 and the passageways in the bar 1. Typically the bar 1 is rotated around the stationary injector 2.

One embodiment of the injection, sealing, valving and passageway system (the "valving system") shown in FIG. 1 comprises a hollow elongate bar 1 which can hydraulically seal with an external injection nozzle 2 by means of a seal or seals 3 and the external injection nozzle 2 may have one or more separate passageways 7 and 8 within it. The hollow elongate bar 1 has a central hole 12 which can accommodate a valve and passageway assembly 4. The valve and passageway assembly 4 may have one or more separate passageways within it 10 or around it 11. The valve and passageway assembly 4 has at least one valve 13 within it or around it. The valve 13 may be operated by a spring 14 or any other means.

In operation the injection nozzle 2 is fitted over or into the end of the hollow bar 1 such that at least one passageway 7 in the injection nozzle 2 hydraulically connects with a passageway 10 in the valve and passageway assembly 4. Additional passageways 8 in the injection nozzle 2 also hydraulically connect with passageways 11 inside or around the valve and passageway assembly 4 inside the hollow bar 1.

Figure 2:
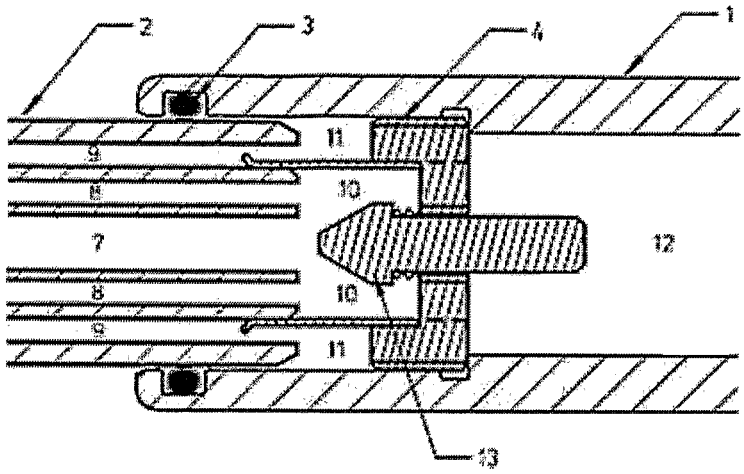
FIG. 2 is a schematic sectional view of a section of an injection, sealing, valving and passageway system according to another preferred embodiment of the invention adapted to be used with a self drilling rock bolt showing a one way valve in an open position.

FIG. 2 shows a sectional view of another embodiment of the valving system whereby the injection nozzle 2 has three separate passageways 7, 8 and 9. FIG. 2 also shows the valve 13 open allowing fluid from passageway 7 to flow into passageway 10 in the valve and passageway assembly 4 and subsequently flow through the valve and passageway assembly 4 and into the central passageway 12 in the hollow bar 1. FIG. 2 also shows that fluid from passageway 8 can flow into passageway 10 in the valve and passageway assembly 4 and subsequently flow through the valve and passageway assembly 4 and into the central passageway 12 in the hollow bar 1. FIG. 2 further shows that the passageway 9 in the injection nozzle 2 hydraulically connects with passageway 11 which in turn connects to the central hole 12 in the hollow bar 1. Passageways 9 and 11 are separate from passageways 7, 8 and 10.

Figure 3:
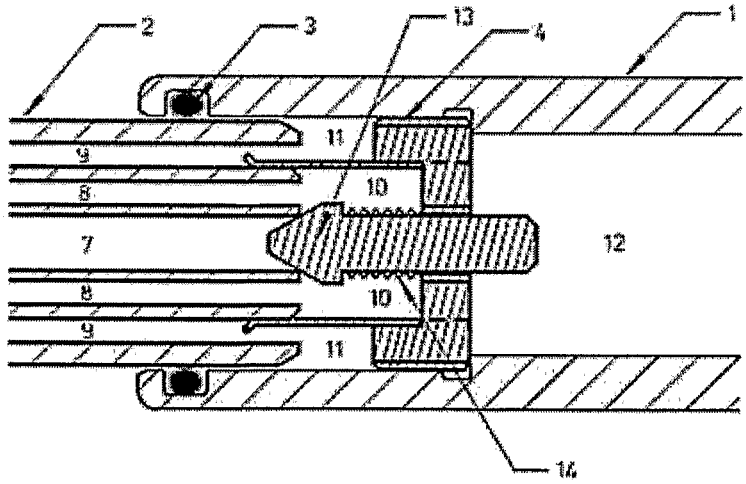
FIG. 3 is a schematic sectional view of an injection, sealing, valving and passageway system according to the same embodiment of the invention shown in FIG. 2 but with a one way valve in a closed position.

FIG. 3 shows a sectional view of the valving system whereby the valve 13 is closed by a spring 14 which prevents back flow of fluids down passageway 7.

Figure 4:
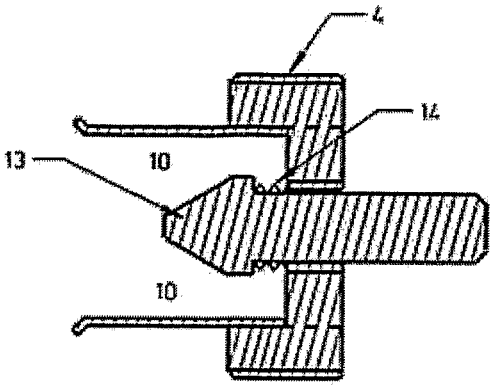
FIG. 4 is a schematic sectional view of a valving assembly which forms part of the same embodiment of the invention shown in FIG. 2.

FIG. 4 shows a sectional view of the valve and passageway assembly 4 with a valve 13 which is operated by a spring 14.

Figure 5:
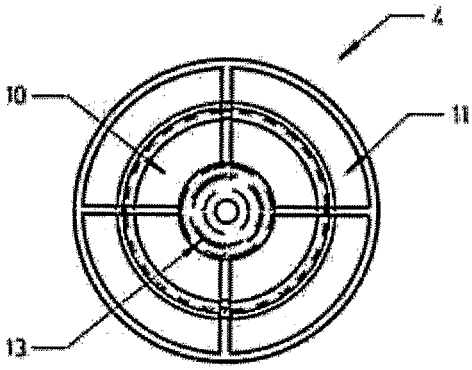
FIG. 5 is an end view of the valving assembly shown in FIG. 4 according to one preferred embodiment of the invention adapted to be used with a self drilling rock bolt.

FIG. 5 shows an end view of the valve and passageway assembly 4 shown in FIG. 4 with a valve 13 and with an internal passageway 10 and another internal passageway 11.

Figure 6:
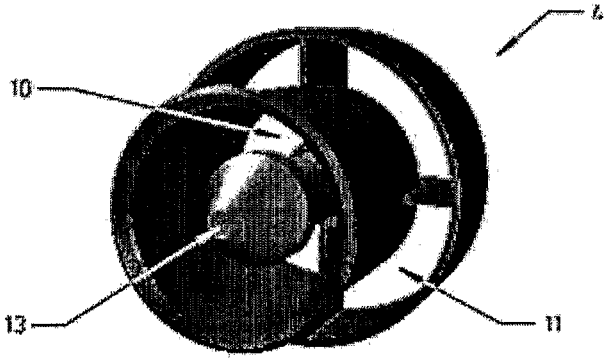
FIG. 6 is a three dimensional view of the valving assembly shown in FIG. 5 according to one preferred embodiment of the invention adapted to be used with a self drilling rock bolt.

FIG. 6 shows a three dimensional view of the valve and passageway assembly 4 shown in FIGS. 4 and 5 with a valve 13 and an internal passageway 10 and another internal passageway 11.

Figure 7:
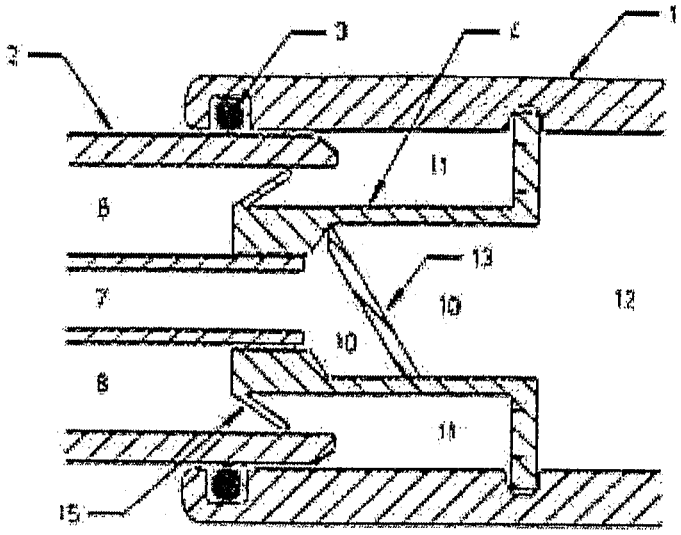
FIG. 7 is a schematic sectional view of an injection, sealing, valving and passageway system according to another preferred embodiment of the invention adapted to be used with a self drilling rock bolt with two one way valves shown in the closed position.

FIG. 7 shows a sectional view of another embodiment of the valving system whereby the injection nozzle 2 has two separate passageways 7 and 8 which hydraulically connect with passageways 10 and 11 in or around the valve and passageway assembly 4. The valve and passageway assembly 4 has an internal valve 13 which is shown in its closed position in FIG. 7. FIG. 7 also shows that the valve and passageway assembly 4 also has an external valve 15 which is also shown in its closed position.

Figure 8:
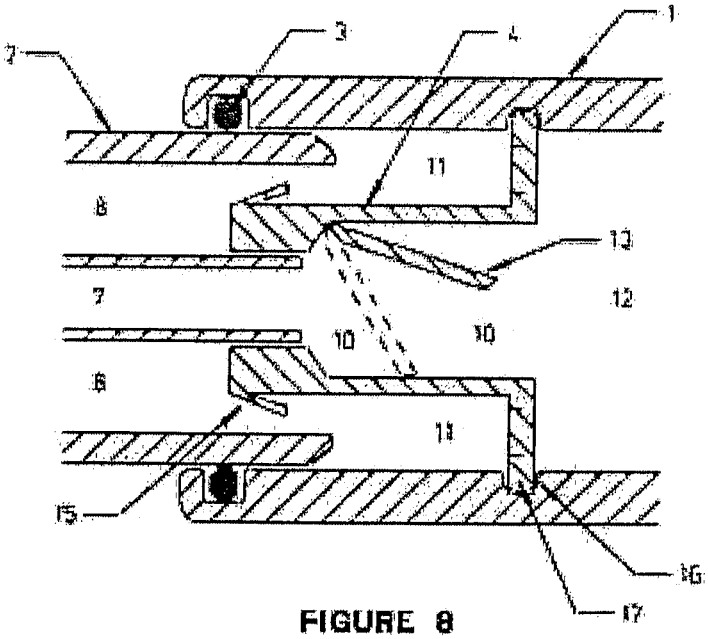
FIG. 8 is a schematic sectional view of an injection, sealing, valving and passageway system according to the preferred embodiment of the invention shown in FIG. 7 adapted to be used with a self drilling rock bolt with two one way valves shown in the open position.

FIG. 8 shows a sectional view of the same embodiment as shown in FIG. 7 except that the valves 13 an 15 are now shown in their open, position allowing fluids to pass from passageway 7 into passageway 10 and through to the central hole 12 in the bar 1, and also from passageway 8 into passageway 11 and through to the central hole 12 in the bar 1. FIG. 8 also shows that the valve and passageway assembly 4 is held in position inside the hollow bar 1 by a locating lug 17 on the assembly 4 which clips into a groove 16 inside the hollow bar 1.

Figure 9:
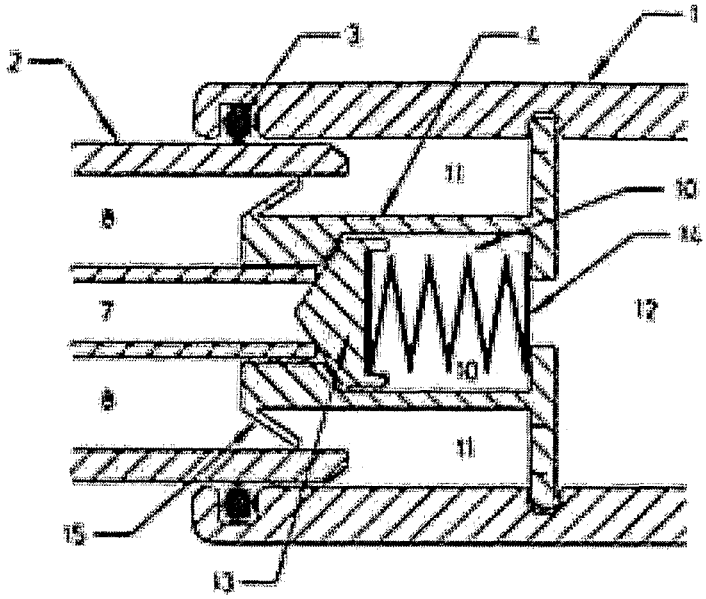
FIG. 9 is a schematic sectional view of an injection, sealing, valving and passageway system according to yet another preferred embodiment of the invention adapted to be used with a self drilling rock bolt with two one way valves shown in the closed position.

FIG. 9 shows a sectional view of another embodiment of the valving system whereby the injection nozzle 2 has two separate passageways 7 and 8 which hydraulically connect with passageways 10 and 11 in or around the valve and passageway assembly 4. The valve and passageway assembly 4 has an internal valve 13 which is activated by an internal spring 14 and which is shown in its closed position in FIG. 9. FIG. 9 also shows that the valve and passageway assembly 4 also has an external valve 15 which is also shown in its closed position.

Figure 10:
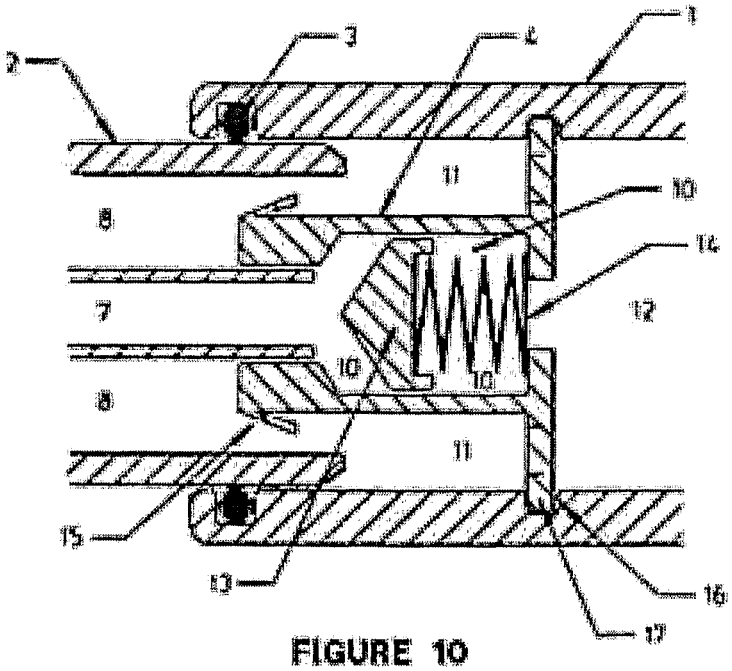
FIG. 10 is a schematic sectional view of an injection, sealing, valving and passageway system according to the preferred embodiment of the invention shown in FIG. 9 adapted to be used with a self drilling rock bolt with two one way valves shown in the open position.

FIG. 10 shows a sectional view of the same embodiment as shown in FIG. 9 except that the valves 13 and 15 are now shown in their open position allowing fluids to pass from passageway 7 into passageway 10 and through to the central hole 12 in the bar 1, and also from passageway 8 into passageway 11 and through to the central hole 12 in the bar 1.

Figure 11:
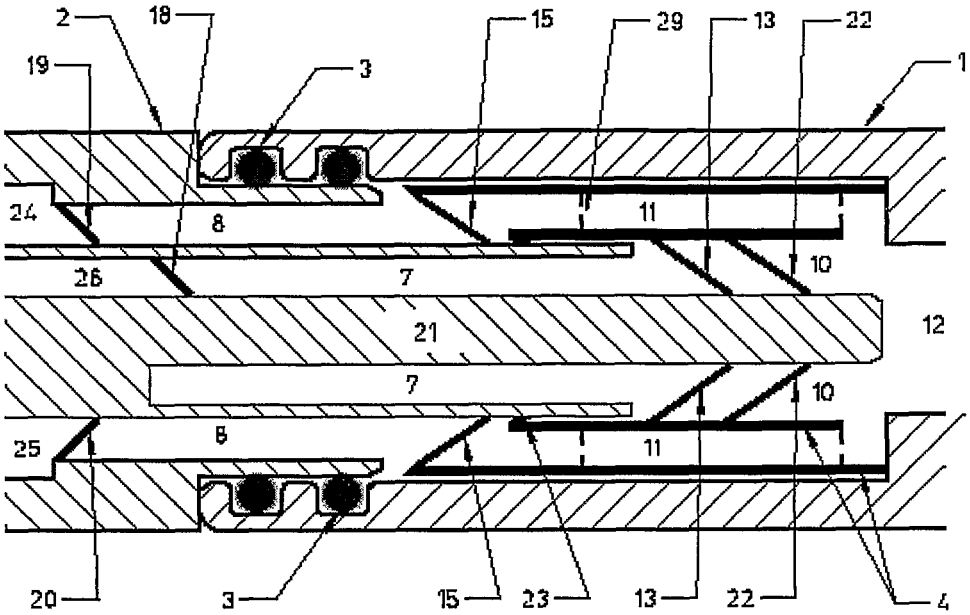
FIG. 11 is a schematic sectional view of an injection, sealing, valving and passageway system according to yet another preferred embodiment of the invention adapted to be used with a self drilling rock bolt with multiple one way valves shown in the closed position.

FIG. 11 shows a sectional view of another preferred embodiment of the valving system whereby an injection nozzle 2 is substantially inserted into a hollow bar 1 and is hydraulically sealed inside the hollow bar 1 by hydraulic seals 3 and 23. Seals 3 and 23 are circular in end view (not shown) and seal against circular parts of the injector 2. The injection nozzle has two internal passageways 24 and 25 which are connected to passageway 8 by two one way valves 19 and 20. The injection nozzle also has another internal passageway 26 which is connected to passageway 7 by a one way valve 18. Bar 1 also contains the valving assembly 4 which has three one way valves 15, 13 and 22. Valves 15, 13 and 22 are preferably circular plastic flap or skirt valves which close against circular parts of the injector 2. The injector 2 has a circular central bar 21 to seal against valves 13 and 22. In this embodiment the valving assembly 4 has two passageways 10 and 11 formed from two tubular sections which are held apart by a member 29. FIG. 11 shows that the injection nozzle 2 has two separate passageways 7 and 8 which hydraulically connect with passageways 10 and 11 respectively. The injection nozzle 2 has two separate passageways 7 and 8 that may also have one or more one way valves 18, 19 and 20 along their length. The one way valves 18, 19 and 20 could be any type of one way flow valves but are preferably spring loaded valves (not shown). FIG. 11 also shows that passageway 8 in the injection nozzle 2 has two one way valves 19 and 20 which are shown in their closed position but which when open allow two different fluids to flow into the passageway 8 from passageways 24 and 25. Valve 19 is typically opened by fluid pressure from passageway 24. Valve 20 is typically opened by fluid pressure from passageway 25. Valve 18 is typically opened by fluid pressure from passageway 26. FIG. 11 also shows that passageway 8 is hydraulically connected to passageway 11 through a one way valve 15 in the valve and passageway assembly 4 which is shown in its closed position. FIG. 11 also shows that passageway 7 is hydraulically connected to passageway 10 through two one way valves 13 and 22 in the valve and passageway assembly 4 which are also shown in their closed position. FIG. 11 also shows that the valve and passageway assembly 4 is inserted into the end of the hollow bar 1 and is prevented from falling out of the hollow bar 1 by the seal 3.

Figure 12:
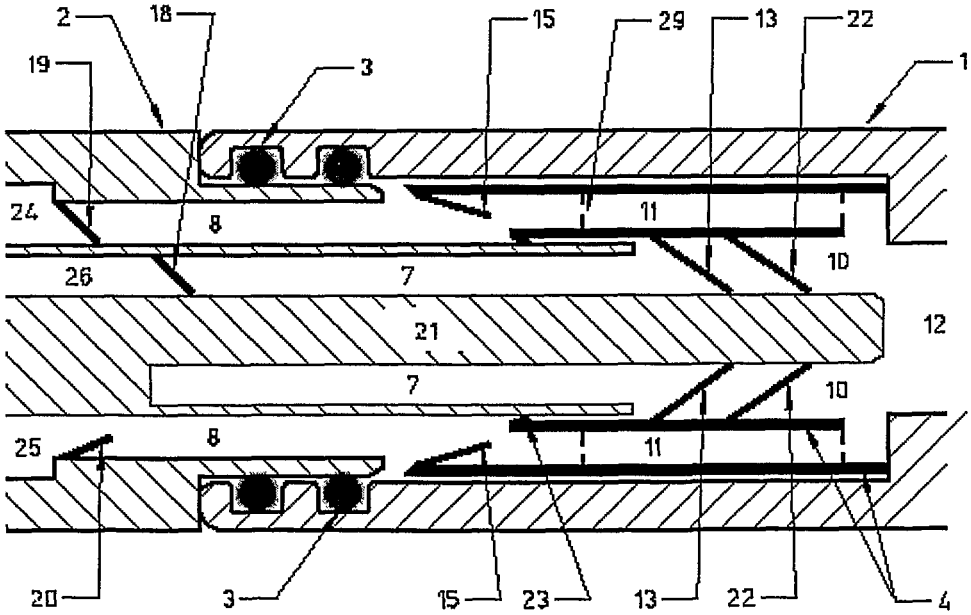
FIG. 12 is a schematic sectional view of an injection, sealing, valving and passageway system according to the preferred embodiment of the invention shown in FIG. 11 adapted to be used with a self drilling rock bolt with the one way valves shown in the open position to allow water flow and with the one way valves for mastic and catalyst flow shown in their closed position.

FIG. 12 shows a sectional view of the same embodiment as shown in FIG. 11 except that the valves 13, 22 and 18 are all in their closed position preventing flow from either direction into passageway 7. Valve 19 is also in its closed position preventing any backflow of fluid back past valve 19. Valves 20 and 15 are in their open positions allowing fluid to flow through valve 20 into passageway 8 and through valve 15 into passageway 11 and then into the central hole 12 in the bar 1. Typically FIG. 12 shows the valve configuration during the drilling cycle where water is pumped through valve 20 and into passageway 8 and then the water pressure opens valve 15 allowing the water to flow through passageway 11 and then into the central hole 12 in the bar 1. The valves 13 and 22 being closed prevent any water from flowing back down passageway 7.

Figure 13:
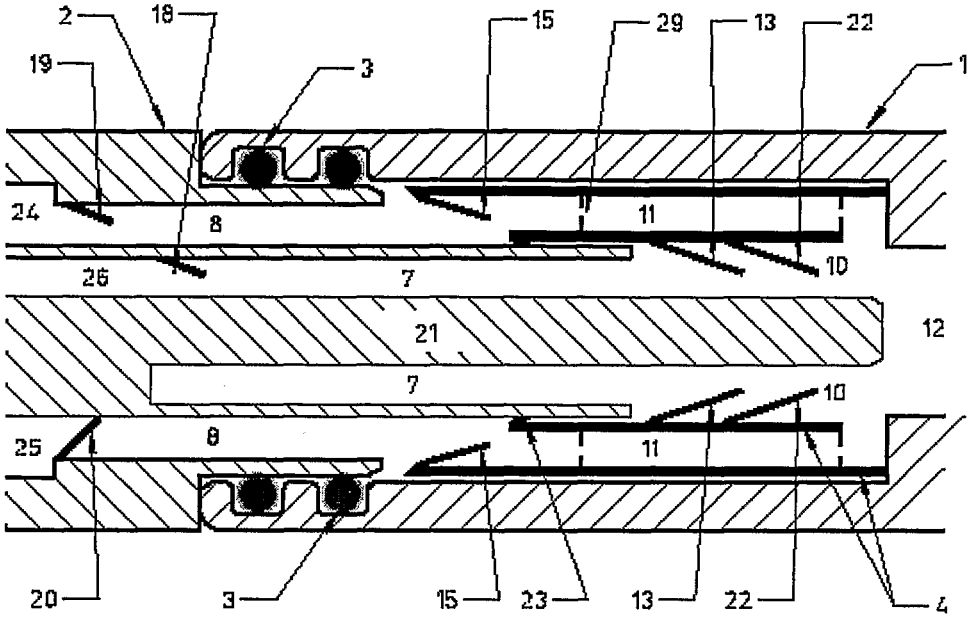
FIG. 13 is a schematic sectional view of an injection, sealing, valving and passageway system according to the preferred embodiment of the invention shown in FIG. 11 adapted to be used with a self drilling rock bolt with the one way valves shown in the open position to enable flow of mastic and catalyst and with the one way valves for water flow in the closed position.

FIG. 13 shows a sectional view of the same embodiment as shown in FIG. 11 except that the valves 18, 13 and 22 are open allowing fluids to flow through passageway 7 and into passageway 10 and into the central hole 12 in the bar 1. Valves 19 and 15 are also open allowing fluids to flow through passageway 8 and into passageway 11 and into the central hole 12 in the bar 1. Valve 20 is closed preventing any back flow of fluids past valve 20. Typically FIG. 13 shows the valve configuration during the resin pumping cycle where one part of a resin, typically a non-water soluble component referred to here as part A, is pumped through passageways 7 and 10, and a second part of a resin, typically a water soluble component referred to here as part B, is pumped through passageways 8 and 11. Valve 15 prevents any back flow of part A into passageway 8 which is the part B passageway. Valves 13 and 22 prevent any back flow of part B into passageway 7 which is the part A passageway.

Figure 14:
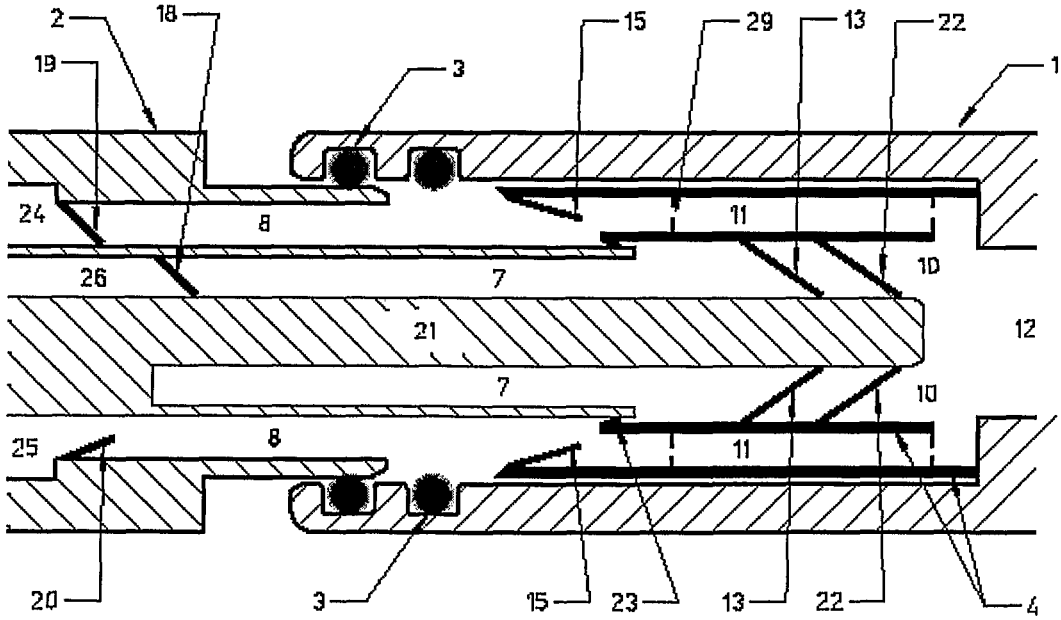
FIG. 14 is a schematic sectional view of an injection, sealing, valving and passageway system according to the preferred embodiment of the invention shown in FIG. 11 adapted to be used with a self drilling rock bolt with the injector partially removed from the bar or bolt but with the injector still hydraulically sealing with the seals and one way valves in the bar or bolt.

FIG. 14 shows a sectional view of the same embodiment as shown in FIG. 11 except that the injection nozzle 2 has been partially removed from the bar 1 and from the valve and passageway assembly 4 but that the injection nozzle 2 is still hydraulically sealing with the bar 1 and with the valve and passageway assembly 4 by means of seals 3 and 23.

Figure 15:
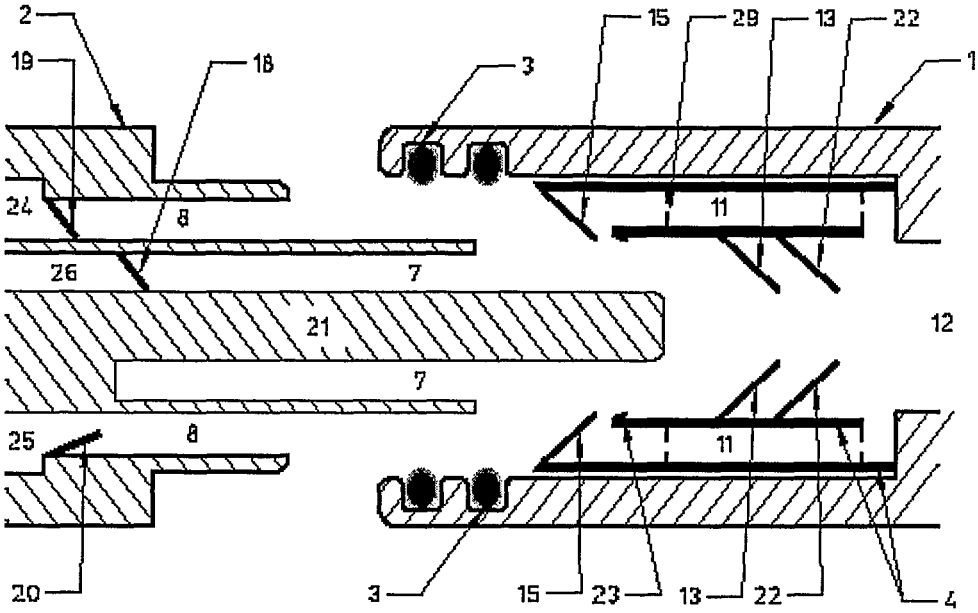
FIG. 15 is a schematic sectional view of an injection, sealing, valving and passageway system according to the preferred embodiment of the invention shown in FIG. 11 adapted to be used with a self drilling rock bolt with the injector fully removed from the bar or bolt.

FIG. 15 shows a sectional view of the same embodiment as shown in FIG. 11 except that the injection nozzle 2 has been fully removed from hydraulically sealing with the valve and passageway assembly 4 and the bar 1. The valve 18 in the passageway 7 is closed, and also the valve 19 in passageway 8 is also closed. The valve 20 in passageway 8 is open. Typically FIG. 15 shows the valve configuration during the water flushing operation where water is pumped through valve 20 and flushes out part B of the resin from passageway 8. Part B of the resin is forced out of passageway 8 by the water and flows past and mixes with any residual part A of the resin remaining near the front of passageway 7 or on the central bar 21. As part B of the resin is rapidly mixes with part A of the resin, the water flow flushes both part B and part A of the resin away from the injection nozzle 2. FIG. 15 also shows that as the flushing water (not shown) flows out of passageway 8, some of this water will also flush and clean the end of the valve and passageway assembly 4. Moreover as the injector is withdrawn from the bar 1, the seals 3 tend to wipe the external surface of passageway 8 clean and remove any excess resin from it. Similarly, seal 23 and skirt valve 15 tend to wipe the external surface of passageway 7 clean and remove any excess resin from it. In addition, skirt valves 13 and 22 tend to wipe the external surface of the central bar 21 clean and remove any excess resin from it.

Figure 16:
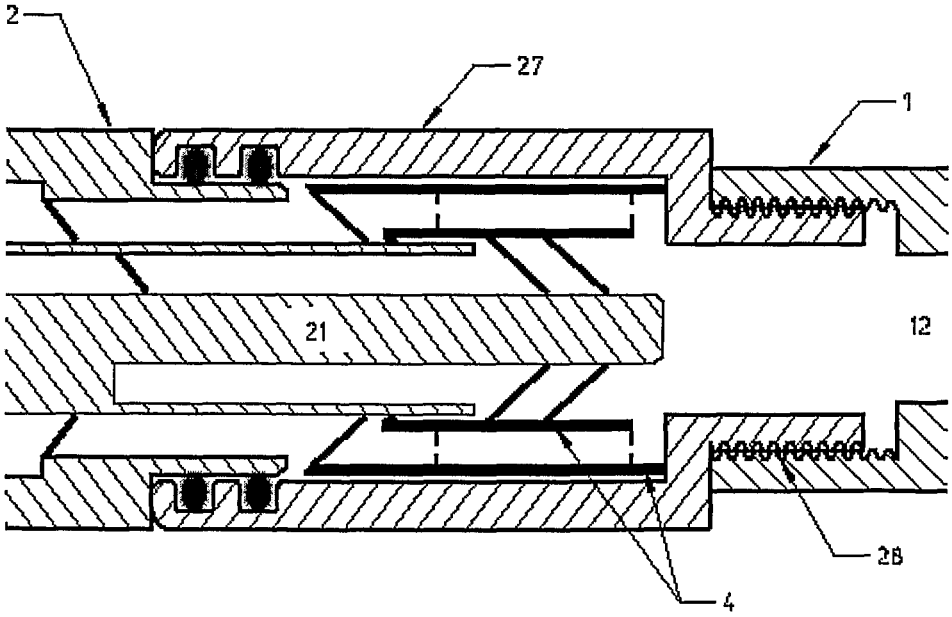
FIG. 16 is a schematic sectional view of an injection, sealing, valving and passageway system according to the preferred embodiment of the invention shown in FIG. 11 adapted to be used with a self drilling rock bolt whereby part or all of the valving and passageway system is contained within an injection sleeve screwed onto the end of the bar or bolt.

FIG. 16 shows a sectional view of the same embodiment as shown in FIG. 11 except that all of the valving assembly 4 is contained within a hollow injection sleeve 27 which is attached to the bar 1 by a thread 28 or by a weld (not shown) or by any other suitable means.

Figure 17:
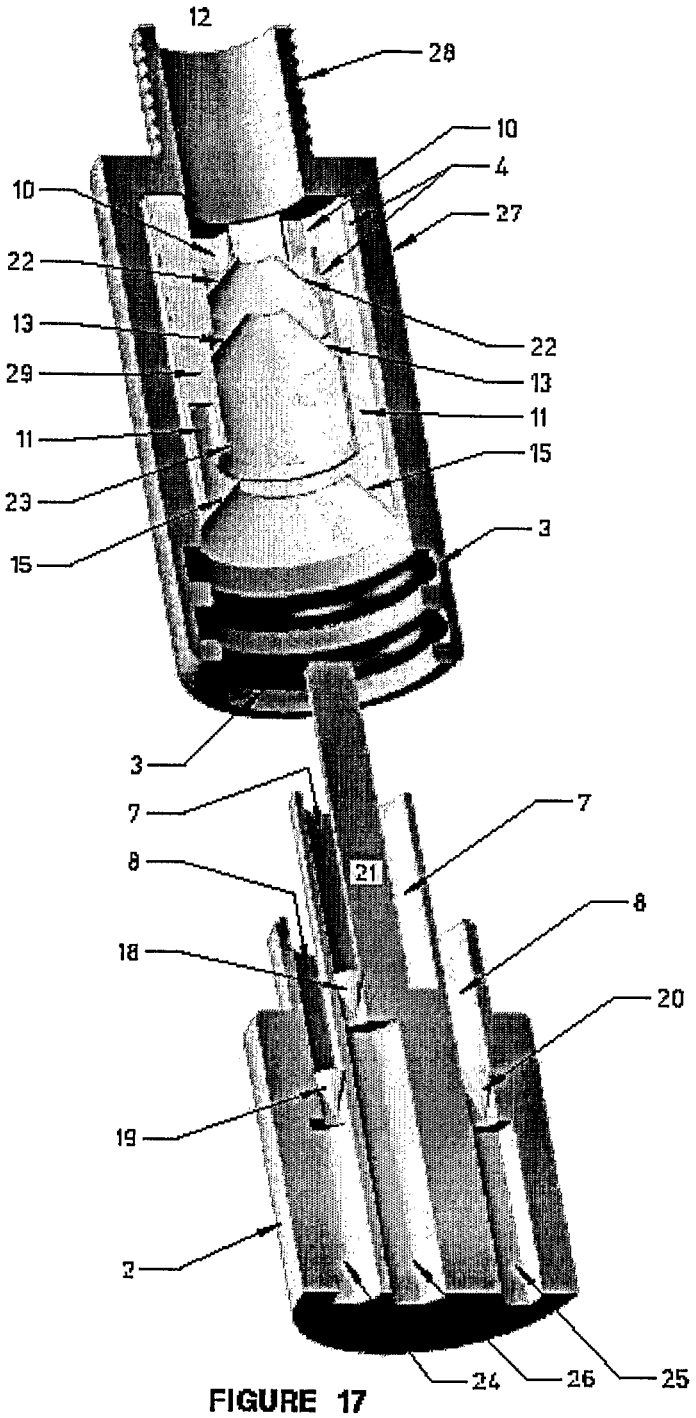
FIG. 17 is a schematic isometric sectional view of an injection, sealing, valving and passageway system according to the preferred embodiment of the invention shown in FIG. 11 adapted to be used with a self drilling rock bolt whereby part of the valving and passageway system is contained within an injection sleeve screwed onto the end of the bar or bolt and where the injector fully removed from the bar or bolt.

FIG. 17 shows a schematic isometric sectional view of the same embodiment as shown in FIG. 11 except that the injector 2 is fully removed from the injection sleeve 27. FIG. 17 shows that the valving assembly 4 is fully contained within the hollow injection sleeve 27, and that the inner and outer tubes of the valving assembly 4 are held apart by a member 29. FIG. 17 also shows that the valves 15, 13 and 22 are circular skirt valves, and that seal 23 is a circular lip seal, and that the seals 3 are O rings. The valves 15, 13, and 22, and the seal 23, and the seals 3, are all circular in end view (not shown) and therefore can rotate about the injector 2 which is also circular in end view (not shown) and still maintain a hydraulic seal. FIG. 17 also shows that the injector 2 has internal passageways 24, 25 and 26 which have one way valves 19, 20 and 18 which control the flow of fluids from passageway 26 into passageway 7 and from passageways 24 and 25 into passageway 8. FIG. 17 further shows that the valving assembly 4 is retained inside the injection sleeve 27 by the O ring 3.

In preferred embodiments, the present invention does not require the use of separate hoses or connectors or other grouting systems and hence removes considerable manual labour as well as reducing injuries to operators. The present invention makes it possible to automatically drill and resin inject or cement grout self drilling rock bolts using automatic or semi-automatic drilling machines.

In preferred embodiments, the present invention enables two or more component chemical resins or grouts to be injected into and through hollow bars or hollow bolts or hollow self drilling rock bolts without premature mixing or back flow, and hence prevents unwanted blockages occurring.

In a particularly preferred embodiment, at least one part of the anchoring fluid is water soluble and can flow into one passageway through a one way valve, and flushing water can then be pumped into the same passageway through a separate one way valve such that the water soluble anchoring fluid can be flushed away with water.

In a preferred embodiment, the valve and passageway assembly and the one way valves used in the valve and passageway assembly are made from plastic, but could be made from any suitable material. The valve and passageway assembly typically comprises two or more substantially tubular components which are assembled together.

In a preferred embodiment, some of the one way valves are flap valves or skirt valves. These flap or skirt valves are opened and closed by the flow of the fluid, and seal against a circular injector or a circular bar.

In a particularly preferred embodiment, there is at least one central circular bar or circular tube that enables at least one flap or skirt valve to close against the external surface of this bar or tube.

In a particularly preferred embodiment, the skirt valves and seals and injector are all designed such that the injector can be partially withdrawn from the bar and still hydraulically seal against the bar and valve assembly.

In a particularly preferred embodiment, part or all of the passageways are contained within a hollow injection sleeve which is threadably attached to the hollow bar and which can be removed from the hollow bar by unscrewing it.

It should be noted that the present invention enables water or air or water and air to be pumped through hollow bars or hollow bolts or hollow self drilling rock bolts with either left hand or right hand drilling rotation. The present invention then also enables two or more component chemical resins or grouts to be injected into and through hollow bars or hollow bolts or hollow self drilling rock bolts without removal of the bar or bolt from the drilling chuck and without back flow of fluids along the wrong passageway. The invention further enables water soluble chemical resin or grout to be flushed away from the leading end of the injector and the end of the bar or bolt by removing the injector from the bar or bolt and turning on water flow as the injector is removed. The present invention even further enables the circular tube and bar sections of the injector to be wiped clean by the skirt valves and by the lip seal and by the O rings as the injector is removed from the bar or bolt. The present invention even further enables the valving assembly to be retained inside the injection sleeve or bar by the O ring seals.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. An injection, sealing, valving and passageway system for injecting fluids for use with a rock bolt, a cable bolt or a hollow injection bar, comprising:

an injector having a first plurality of fluid passageways configured for fluid to flow along one of said first plurality of fluid passageways without cross contamination with fluid flowing along another one of said first plurality of fluid passageways;

a valving assembly contained within a hollow member of the rock bolt or cable bolt or injection bar, the valving assembly having a second plurality of passageways communicating with said first plurality of passageways;

a connection providing a hydraulic seal between the first passageways of the injector and the second passageways of the valving assembly both in presence and absence of relative rotation between the injector and the valving assembly; and at least one of the second passageways has at least one one-way flow valve to prevent backflow of fluid into the injector, wherein fluids injected through at least two of said first plurality of passageways of the injector are kept separate until downstream of the one way flow valve.

2. The system of claim 1 wherein at least one of the second passageways is adapted to receive fluids from at least two of said first passageways to allow flow of one or more fluids alone said at least one of the second passageways either sequentially or simultaneously.

3. The system of claim 2 wherein said passageway is adapted to allow flow of an anchoring fluid and a flushing fluid sequentially.

4. The system of claim 1 wherein the valving assembly is made from plastic and is inserted into the end of a hollow self drilling rock bolt, said valving assembly being configured to receive an injection nozzle of the injector so as to form said hydraulic seal.

5. The system of claim 1 wherein said first plurality of passageways includes respective passageways adapted for injection of a hardenable component and a hardening component of a two part anchoring fluid without cross-contamination of the components within the injector or the valving assembly.

6. The system of claim 5 wherein the injector and the valving assembly are adapted to keep the hardenable component and hardening component separate within the injector and to bring the components into contact downstream of the second passageways.

7. The system of claim 1 wherein the second passageways include an inner passageway and an outer annular passageway of the valving assembly and wherein each of the inner passageway and the outer annular passageway of the valving assembly has a one-way valve.

8. The system of claim 1 wherein each of the first passageways has a one-way valve to prevent backflow.

9. The system of claim 1 wherein the first plurality of passageways includes at least one an inner passageway of the injector, and at least one outer passageway of the injector, and wherein the second plurality of passageways includes an inner passageway and an outer annular passageway of the valving assembly, whereby the outer annular passageway of the valving assembly communicates with the at least one outer passageway of the injector, and the inner passageway of the valving assembly communicates with the at least one inner passageway of the injector.

10. The system of claim 9 wherein the injector has a projection adapted for insertion into the inner passageway of the valving assembly and to seal against a said one-way valve within the inner passageway.

11. The system of claim 10 wherein the second passageways include an inner passageway and an outer annular passageway of the valving assembly and wherein the injector further seals against a seal of a wall of said outer annular passageway.

12. A valving assembly adapted to co-operate with an injector for use in injection of fluids to one of a rock bolt and a cable bolt and a hollow injection bar, the injector having a first plurality of fluid passageways configured for fluids to flow along them without cross contamination with the fluids in another passageway, the valving assembly being adapted to be contained within a hollow member of the rock bolt or cable bolt or injection bar, the valving assembly having a second plurality of passageways communicating with said first plurality of passageways, and a connection providing a hydraulic seal between the first passageways of the injector and the second passageways of the valving assembly both in presence and absence of relative rotation between the injector and the valving assembly, at least one of the second passageways having at least one one-way flow valve to prevent backflow of fluid and the second passageways being adapted to keep separate fluids injected through at least two of said first plurality of passageways of the injector until downstream of the one way flow valve.

13. The valving assembly of claim 12 wherein at least one of said second passageways is adapted to receive fluids from at least two of said first passageways to allow flow of one or more fluids along it either sequentially or simultaneously.

14. The valving assembly of claim 12 wherein said passageway is adapted to allow flow of an anchoring fluid and a flushing fluid sequentially.

15. The valving assembly of claim 12 wherein said second plurality of passageways include respective passageways adapted for injection of a hardenable component and a hardening component of a two part anchoring fluid without cross-contamination of the components within the valving assembly.

16. The valving assembly of claim 15 wherein the second passageways are adapted to keep the hardenable component and hardening component separate and to bring the components into contact spaced downstream of the second passageways.

17. The valving assembly of claim 12 wherein the second passageways include an inner passageway and an outer annular passageway of the valving assembly and wherein each of the inner passageway and the outer annular passageway of the valving assembly has a one-way valve.

18. The valving assembly of claim 12 wherein the valving assembly is adapted to be inserted in an end of a hollow self drilling rock bolt.

19. The valving assembly of any of claim 12 wherein the valving assembly substantially wipes an injection nozzle of the injector clean when the injection nozzle is withdrawn from the valving assembly.

20. The valving assembly of claim 12 wherein the one-way flow valves in the valving assembly are skirt valves or flap valves.

21. The valving assembly of claim 12 wherein the inner passageway of the valving assembly is adapted to receive a projection of the injector such that the projection seals against a said one-way valve within the inner passageway.

* * * * *